US007350648B2

(12) United States Patent
Gerstner et al.

(10) Patent No.: US 7,350,648 B2
(45) Date of Patent: Apr. 1, 2008

(54) MODULAR DISPLAY SYSTEM

(75) Inventors: Robert Gerstner, Sleepy Hollow, NY (US); R. Christopher Kidd, New York, NY (US)

(73) Assignee: Lloyd, Gerstner & Partners, Montvale, NJ (US)

( * ) Notice: Subject to any disclaimer, the term of this patent is extended or adjusted under 35 U.S.C. 154(b) by 368 days.

(21) Appl. No.: 10/834,741

(22) Filed: Apr. 29, 2004

(65) Prior Publication Data

US 2004/0217077 A1 Nov. 4, 2004

Related U.S. Application Data

(60) Provisional application No. 60/466,671, filed on Apr. 30, 2003.

(51) Int. Cl.
*A47F 5/08* (2006.01)

(52) U.S. Cl. ..... 211/87.01; 211/126.15; 211/194; 206/509; 312/111

(58) Field of Classification Search ..... 211/194, 211/40, 188, 126.3, 126.15; 206/509; 312/111
See application file for complete search history.

(56) References Cited

U.S. PATENT DOCUMENTS 3,224,822 A * 12/1965 Kirby ..... 312/71
3,401,993 A * 9/1968 Fenkel ..... 312/111
3,552,817 A * 1/1971 Marcolongo ..... 312/107
3,851,936 A * 12/1974 Muller ..... 312/108
3,907,116 A * 9/1975 Wolf et al. ..... 211/40
4,178,047 A * 12/1979 Welch ..... 312/140
4,243,279 A * 1/1981 Ackeret ..... 312/107
4,317,603 A * 3/1982 Pepicelli et al. ..... 312/9.47
4,328,902 A * 5/1982 North ..... 220/23.4
4,420,196 A * 12/1983 Fuller ..... 312/186
5,271,515 A * 12/1993 Berkheimer et al. ..... 220/4.27
5,375,709 A * 12/1994 Petro ..... 206/709
5,775,046 A * 7/1998 Fanger et al. ..... 52/590.1
6,050,657 A * 4/2000 Hiltzman ..... 312/111

* cited by examiner

*Primary Examiner*—James A. Kramer
*Assistant Examiner*—Jared W. Newton
(74) *Attorney, Agent, or Firm*—Cohen Pontani Lieberman & Pavane LLP

(57) ABSTRACT

A modular display system comprises a plurality of identical modules. Each module includes a vertical mounting surface, a pair of sidewalls, top surface and a bottom surface lying in planes which extend at right angles to the mounting surface. A pair of top rails lie above the top plane and form outward facing channels. A pair of bottom rails extend inward from respective sidewalls just above the bottom plane, each bottom rail engaging in a respective channel when two modules are assembled one above the other. The inner surfaces of at least one of the top rails and the bottom rails converge toward the top or bottom plane at an acute angle so that the inner surfaces of the top rails are received against the inner surfaces of the bottom rails in a press fit. The modules are latched in this position by a detent and shoulder arrangement.

18 Claims, 4 Drawing Sheets

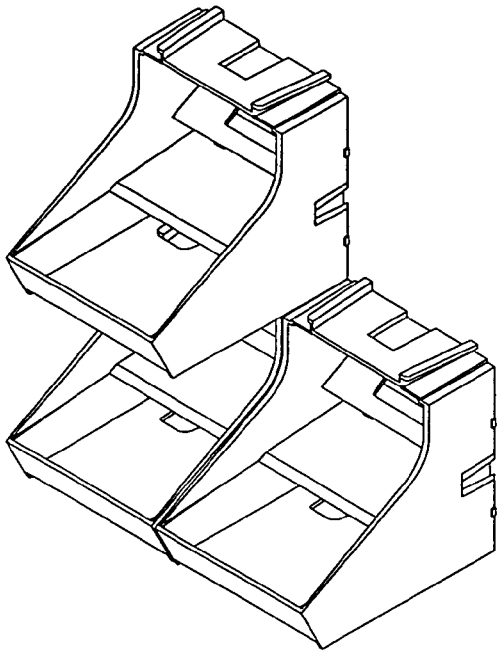
FIG. 3
FIG. 4
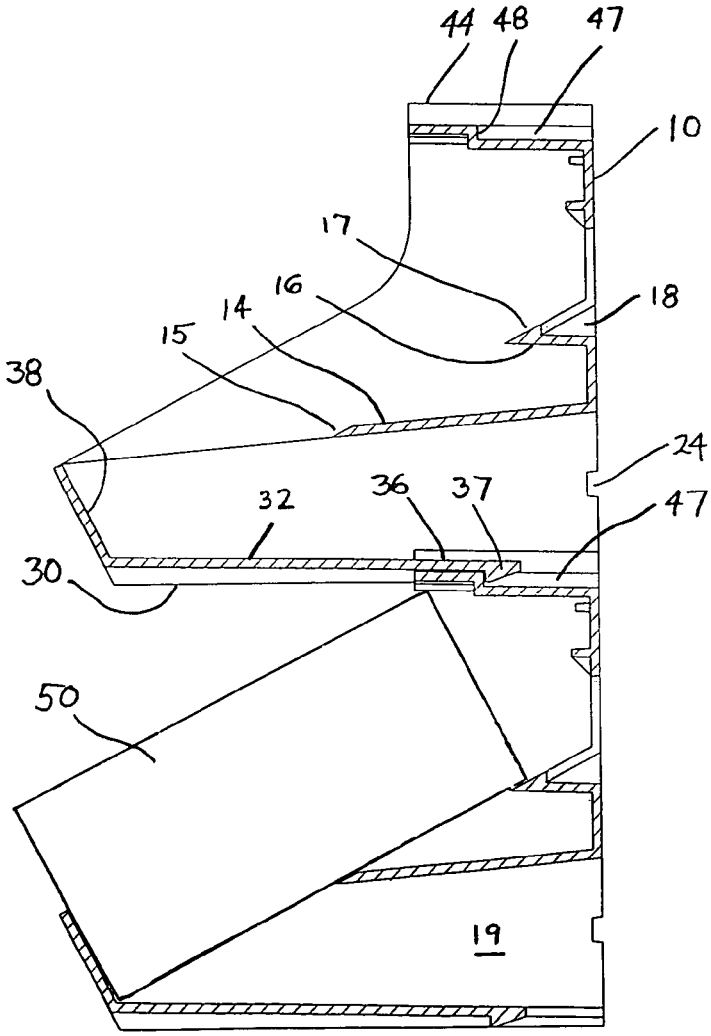

MODULAR DISPLAY SYSTEM

RELATED APPLICATIONS

This application claims priority under 35 U.S.C. §119(e) from U.S. Provisional Application Ser. No. 60/466,671, filed on Apr. 30, 2003.

BACKGROUND OF THE INVENTION

1. Field of the Invention

The invention relates to a modular display system having modules of injection molded plastic which can be locked together.

2. Description of the Related Art

Display systems for merchandise are commonly designed so that the system can be expanded to any desired size, typically by attaching support trays and dividers to backing plates or support columns. These systems generally require a number of different parts which are assembled together, and may also require the use of fasteners to reinforce the structure, particularly where large displays are involved. Not only are such systems complex, expensive, and lacking in sturdiness, but they are subject to arranging in a multiplicity of different configurations by a merchandiser, which may not be desirable to a manufacturer who desires to have a unique appearance for a display containing his product.

SUMMARY OF THE INVENTION

It is an object of the invention to provide a display system of substantially identical modules which can be easily assembled together to form a display system.

It is a further object to manufacture a display module which can be latched to a like module both side-by-side and one above the other to form an array of rows and columns of any desired size.

It is a related object to provide modules which can be assembled together to form a sturdy array which cannot be readily dismantled.

It is another object to manufacture a module in a straight draw injection molding process so that the modules can be made inexpensively.

According to the invention, these and other objects are achieved with an injection molded module having a vertical mounting surface lying in a mounting plane, a pair of parallel sidewalls having opposed outside surfaces lying in side planes extending forward from the mounting plane at right angles to the mounting plane, a bottom surface lying in a bottom plane extending forward from the mounting plane at right angles to the mounting plane and the sidewalls; and a top surface lying in a top plane extending forward from the mounting plane at right angles to the mounting plane and the side planes. A pair of top rails lie above the top plane, each top rail having an inside surface which faces the top plane to form a channel, the channels facing respective side planes, and a pair of bottom rails extending inward from respective sidewalls above the bottom plane, each bottom rail having an inner surface which faces away from the bottom plane. The inner surfaces of at least one of the top rails and the bottom rails converge toward a respective at least one of the top plane and the bottom plane at an acute angle, whereby the inner surfaces of the top rails of one module are received against the inner surfaces of the bottom rails of another module in a press fit when the top surface of one module is received against the bottom surface of another module and the modules are slid together until their mounting planes are substantially coplanar. The modules are latched in this position by a detent and shoulder arrangement.

In order to latch modules together side-by-side, one of the sidewalls has a dovetail tenon standing proud of the outside surface and the other sidewall has a dovetail mortise inset in the outside surface, wherein the dovetail tenon of one module is received in the dovetail mortise of another module in a press fit when the one sidewall of one module is slid against the other sidewall of the other module until their mounting planes are substantially coplanar. The mortise and tenon each diverge toward the mounting plane at an acute angle, the one sidewall having an edge recess forming a shoulder below the outside surface and the other sidewall having a detent standing proud of the outside surface. The detent of one module engages the shoulder of another module to latch the modules together when the modules are slid together until the mortise and tenon are fully engaged.

Each module is designed and constructed so that it can be molded in a straight-draw mold wherein a cavity for injection molding is formed by moving two mold halves together without the use of any additional core pins. This is achieved by having all surfaces which face rearward to any degree face openings in the rear mounting surface which receive core parts of a mold half moving forward. Likewise, all forward facing surfaces are accessible to core parts of the opposite mold half.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

FIG. 3 is a front perspective tree of the modules of FIG. 1 assembled together;

FIG. 4 is vertical section view of two of the modules assembled together for displaying a product;

DETAILED DESCRIPTION OF THE PRESENTLY PREFERRED EMBODIMENTS

Figure 1:
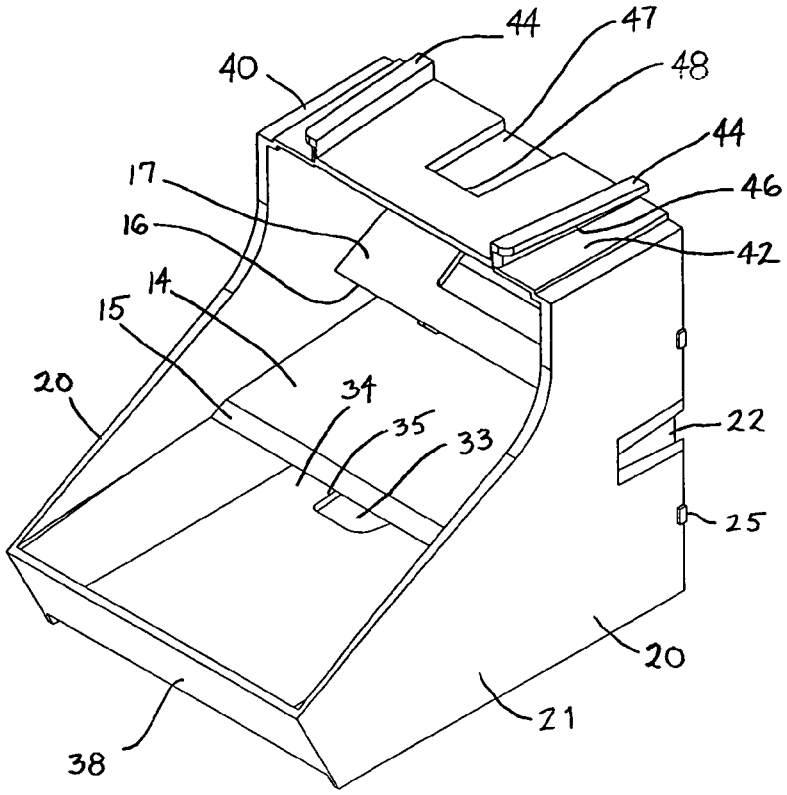
FIG. 1 is front/top perspective of a first embodiment of display module according to the invention.
Figure 2:
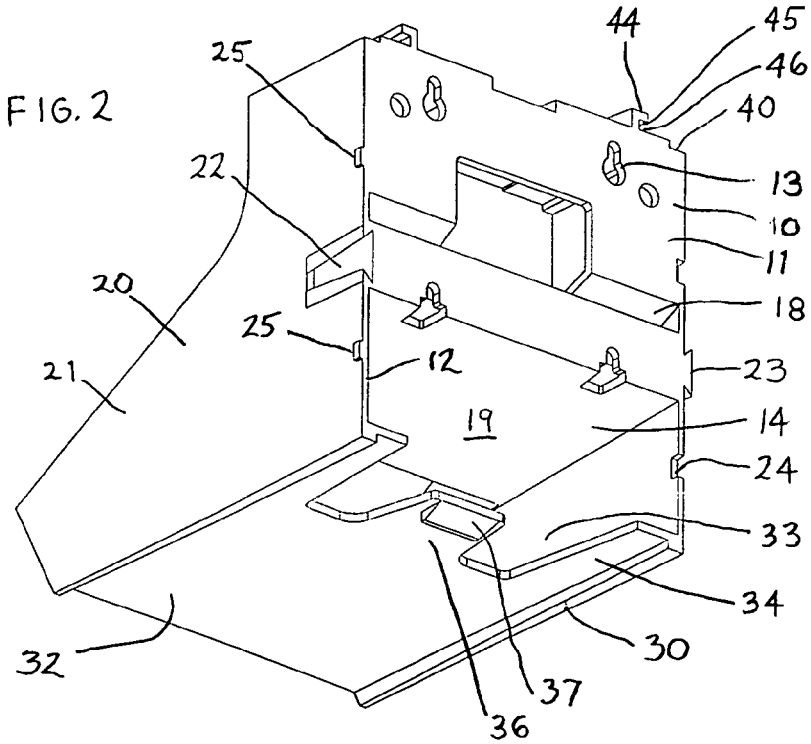
FIG. 2 is a rear/bottom perspective of the module of FIG. 1.

FIGS. 1 and 2 show a first embodiment of a display module which is constructed so that a number of identical modules can be assembled together both side-by-side and one above the other, as shown in FIG. 3. Each module has a vertical mounting surface 10 lying in a mounting plane, a pair of parallel sidewalls 20 having opposed outside surfaces 21 lying in side planes which extend forward from the mounting plane at right angles, a bottom surface 30 lying in a bottom plane extending forward from the mounting plane at right angles to the mounting plane and the side planes, and a top surface 40 lying in a top plane which extends forward from the mounting plane at right angles to the mounting plane and the side planes.

The mounting surface 10 includes a main portion 11 and edge portions 12, the main portion being provided with mounting holes 13, which are pear shaped for engaging screw heads. A first ledge 14 extends forward from the mounting plane to a support surface 15, the first ledge 14 sloping toward the floor 32 so that a core pin can be received in the cavity 19 during the molding process. A second ledge 16, best seen in FIG. 4, extends forward from the mounting plane to a support surface 17, the ledge 16 and the surface 17 being formed by a core pin received in recess 18 during the molding process.

One of the sidewalls 20 is provided with a dovetail mortise 22 which is inset in the outside surface 21, and the other sidewall 20 is provided with a dovetail tenon 23 which stands proud of the surface 21. Both the mortise 22 and the tenon 23 diverge toward the mounting plane at an acute angle, so that the sidewall of one module can be slid forward against the other sidewall of another module until the tenon 23 is seated in the mortise 22 and the mounting planes are substantially coplanar. The sidewall 20 provided with the tenon 23 is also provided with a pair of recesses 24 each forming a shoulder below said outside surface 21. The sidewall 20 provided with the mortise 22 is also provided with a pair of detents 25 standing proud of the outside surface 21 adjacent to the mounting surface 30. When two modules are slid together side-by-side until the tenon of one module is received in the mortise of another module and the mounting planes are coplanar, the detents 25 will snap into the recesses 24 so that the modules can not be moved relative to each other unless the abutting sidewalls are flexed apart so that the detents no longer engage the shoulders.

Extending between the sidewalls 20 is a floor 32 which is spaced from the bottom surface 30 and inclined at an acute angle to the bottom plane, the floor 32 being provided with an open area 33 which extends forward from the mounting plane to form a pair of bottom rails 34 extending inward from respective sidewalls 20. Since the bottom rails 34 are formed by the floor 32, each rail 34 has an inner or upper surface 35 which is inclined at an acute angle to the bottom plane. The floor is also formed with a tongue 36 which extends rearward into the open area 33, the tongue 36 being provided with a detent 37 for latching another module as will be described.

The top surface 40, against which the bottom surface 30 of another module can be fitted, is (like the bottom surface) essentially confined to two parallel strips along the edges of the sidewalls 20. A raised surface 42 is elevated slightly above the plane of the top surface 40 and inclined at an acute angle thereto. A pair of top rails 44 extend above the raised surface 42, each top rail 44 having an inner surface 45 which is parallel to the top plane, thereby forming a channel 46 of decreasing width. A recess 47 is provided in a central surface 43 extending between the rails, the recess 47 forming a rearward facing shoulder 48.

In order to assemble the modules into the configuration of FIG. 3, the module thereabove is slid rearward with the bottom rails 34 of the upper module received in the channels 46 in the lower module until the detent 37 engages the shoulder 48 to latch the modules together, as shown in FIG. 4. During this movement, the inclined inner surfaces 35 of the bottom rails 34 engage the inner surfaces 45 of the top rails 44 like a wedge to force the bottom surface 30 against the top surface 40 so that the two modules are loaded together to form a solid structure with no play between the modules. The module shown on the lower right is then slid forward against the module on the lower left with the sidewalls 20 juxtaposed, the tenon 23 moving into the mortise 22 until the mounting surfaces are substantially coplanar, at which point the detents 25 snap into the recesses 24 to latch the modules together. Having done this, however, it is no longer possible to add a module on the upper right, because it would have to be moved rearward onto the module on the lower right but forward onto the module on the upper left. The top and side latching constructions therefore require that the modules be assembled either as rows or columns to form subassemblies which are then fitted together. Since this construction would also require the release of entire rows or columns of detents in order to dismantle an assembly of modules, an exceptionally rigid construction which cannot be readily dismantled is achieved.

In addition to showing the latching features between two modules assembled one above the other, FIG. 4 also shows how a product 50 such as a box of candy or gum packages is received for display, resting against floor 32, front wall 38, and support surfaces 15, 17. A very important manufacturing advantage is also apparent in FIG. 4. That is, each module is designed and constructed so that it can be molded in a straight-draw mold wherein a cavity for injection molding is formed by moving two mold halves together without the use of any additional core pins. This is because all surfaces which face rearward to any degree face openings in the rear mounting surface, e.g. the first ledge 14, floor 32, and front end 38 facing the cavity 19, which receive core parts of a mold half moving forward. Likewise, all forward facing surfaces are accessible to core parts of the opposite mold half. Thus, saying that the module can be formed in a straight-draw mold is shorthand for a structure having surfaces arranged in this way.

A second embodiment of the module according to the invention, which is suitable for displaying flat packages such as CD's or DVD's, is shown in FIGS. 5-8. This embodiment is also constructed so that a number of identical modules can be assembled together both side-by-side and one above the other. Each module has a vertical mounting surface 110 lying in a mounting plane, a pair of parallel sidewalls 120 having opposed outside surfaces 121 lying in side planes which extend forward from the mounting plane at right angles, a bottom surface 130 lying in a bottom plane extending forward from the mounting plane at right angles to the mounting plane and the side planes, and a top surface 140 lying in a top plane which extends forward from the mounting plane at right angles to the mounting plane and the side planes.

The mounting surface 110 includes a central portion 111 and edge portions 112 which are separated from the central portion by apertures 113. A first ledge 114 extends forward from the mounting plane to a support surface 115, which is formed by a core pin received in molding cavity 116. Mounting holes 117 are recessed below the mounting plane. A tongue-like clip 118 extends forward from the mounting plane into a cavity 119 formed oppositely from the central portion 111 of the mounting surface.

The sidewalls 120 have features which are substantially identical to the features of sidewalls 20 of the first embodiment. One of the sidewalls 120 is provided with a dovetail mortise 122, which is inset in the outside surface 121, and a pair of detents 125. The other sidewall 120 is provided with a dovetail tenon 123, which stands proud of the surface 121, and a pair of recesses 124 which receive detents 125 when the tenon 123 of one module is pushed home in the mortise 122 of another module.

Extending forward from the central portion 111 of the mounting surface and diverging slightly apart are intermediate walls 126, which also bound the apertures 113. The intermediate walls 126 extend to respective forward edges 127, which are coplanar and serve as a stop for a pusher plate, as will be described.

The bottom surface 130 includes a central portion 136, which is also bounded by the intermediate walls 126, and edge portions 131 at the bottoms of sidewalls 120. A pair of subfloors 132 extend between the sidewalls 120 and respective intermediate walls 126, the subfloors being spaced from the bottom plane to form recesses 133. A pair of bottom rails 134 extend into respective recesses 133 from respective sidewalls 120, each bottom rail 134 having an inner or upper surface 135 which is inclined at an acute angle to the bottom plane. The central portion 136 is also provided with a detent 137 for latching purposes, and an aperture 138 for accessing a core pin to mold the clip 118.

The top surface 140 includes two parallel strips along the top edges of the sidewalls 120, against which the bottom surface 130 of another module can be fitted, and a lip 148 extending around the front edge. A pair of top rails 144 extend above the top surface 140, each top rail 144 being formed on the edge of a platform 143 and having an inner surface 145 which is inclined at an acute angle to the top plane, thereby forming a channel 146 of decreasing width. Wedge surfaces 142 lying on the top surface, opposite the inner surfaces 145, increase the convergence of the channels. A recess 147 is located between the platforms 143, thereby forming a shoulder at lip 148.

Figure 5:
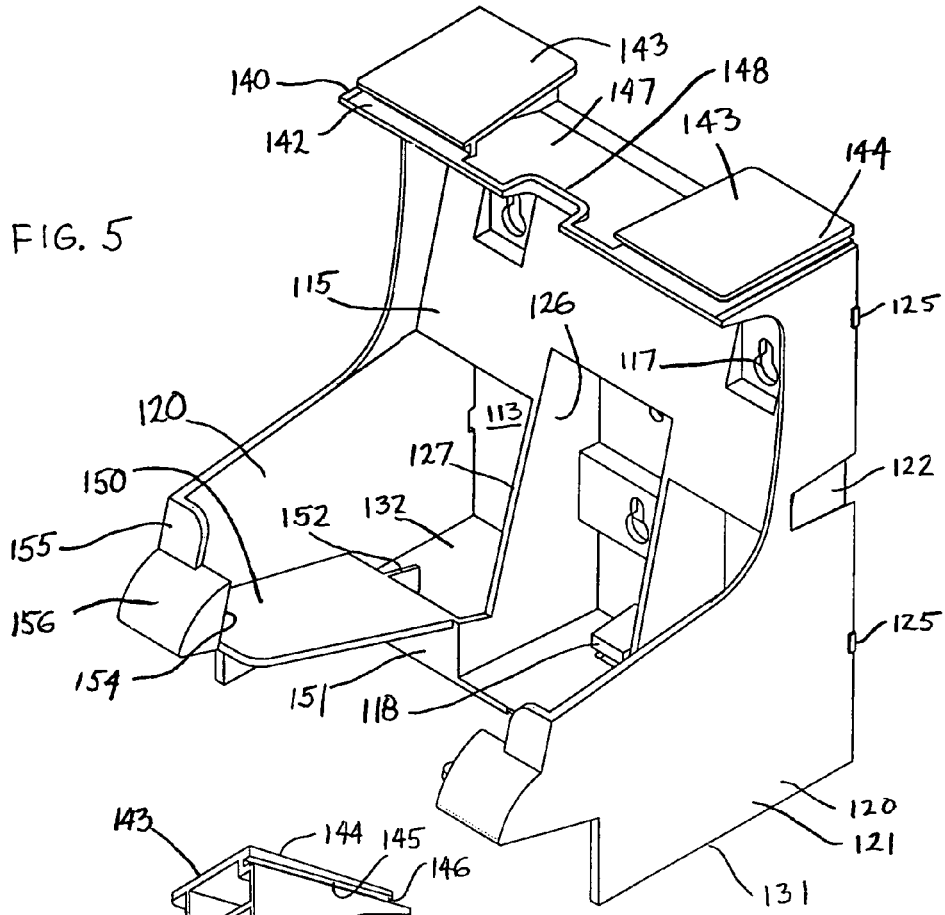
FIG. 5 is a front/top perspective of a second embodiment of a display module according to the invention.

Referring particularly to FIG. 5, the subfloors 132 extend forward to transverse walls 151, which extend between the sidewalls 120 and the intermediate walls 126, and are reinforced by braces 152 for extra rigidity. A pair of spaced apart floors 150 extend forward from the transverse walls 151 to front walls 154, which have raised portions 155 and front panels 156. The floors 150 are inclined at an acute angle to the bottom plane, so that their top surfaces may be accessed by core pins received through apertures 113 during the molding process.

Figure 7:
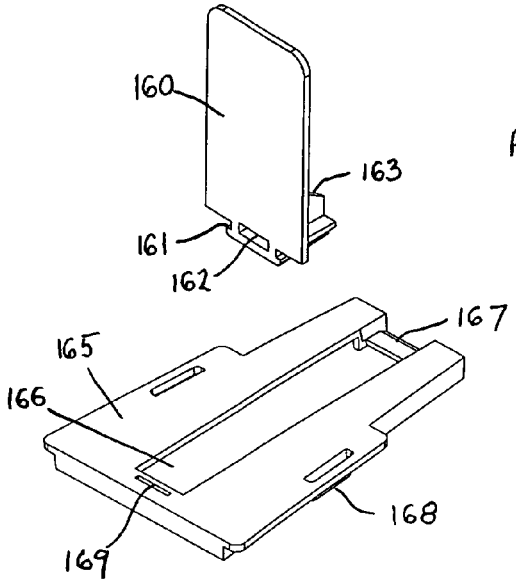
FIG. 7 is an exploded perspective of the track plate and pusher plate for the module of FIG. 5.

FIG. 7 shows a pusher plate 160 which is fitted to a track plate 165, which in turn is fitted between the floors 150. The track plate 165 is provided with side tabs 168 which fit under the inside edges of respective floors 150, and a central aperture 166 having a rear end spanned by a crossbar 167 which is engaged by clip 118 to fix the track plate 165 in the module. The forward end of the track plate has an aperture 168 for hooking an extended end of a spiral spring. The pusher plate 160 is molded with a pair of outward facing channels 161 which engage the edges of the aperture 166 of the track plate, an aperture 162 which receives an extended portion of the spiral spring, and a pair of rear walls 163 reinforce the structure and provide a nest for the spring therebetween.

Figure 8:
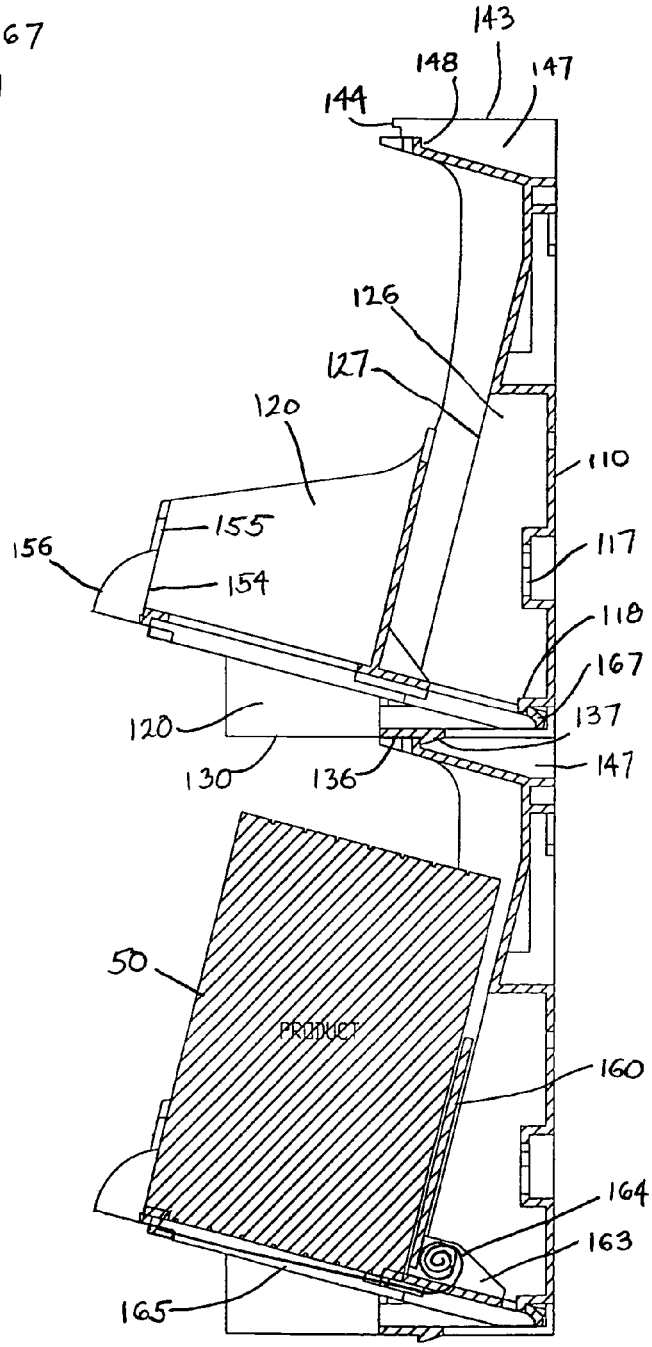
FIG. 8 is a vertical section view of two of the modules assembled together for displaying CD's.

FIG. 8 shows two of the modules latched together one above the other. The lower module is provided with a spiral spring 164 having a coil portion received between the walls 163, and an extended portion hooked to the track plate 165 to load the pusher plate 160 forward against the product 50. This causes the product, for example a stack of CD's, to be loaded against the front walls 154 as the individual CD's are removed. The module is also functional to display CD's when the pusher plate 160 and track 165 are not in place; the raised portions 155 prevent product which may lean forward from falling out of the display module.

Figure 6:
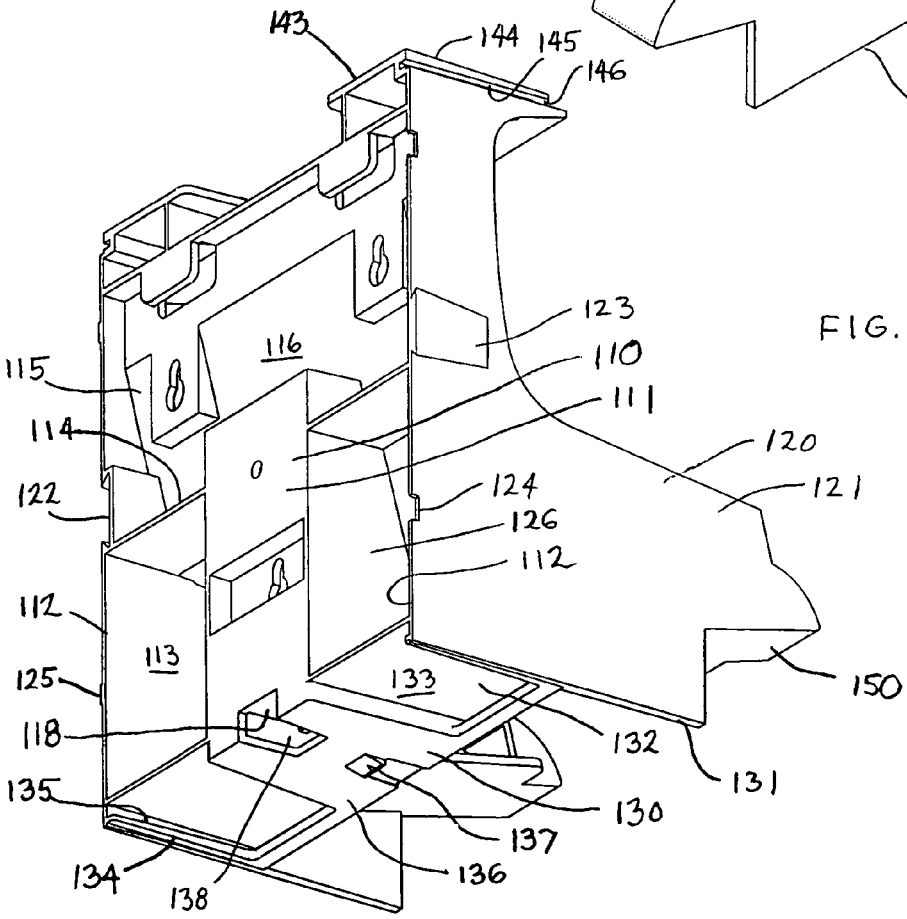
FIG. 6 is a rear/bottom perspective of the display of FIG. 5.

FIG. 8 also shows the cooperation of various features discussed in conjunction with FIGS. 5 and 6, including the cooperation of detent 137 and lip 148 to latch the modules together, and the clip 118 and crossbar 167 to latch the track plate in the module. It will also be apparent that the second embodiment of the module can be injection molded in a straight draw mold, wherein the molding cavity is formed by only two mold halves which are moved toward each other prior to molding and away from each other after the plastic has been injected.

The plastic used for molding the modules is preferably K-Resin, a styrene co-polymer which is modified with butadiene and a clarifying agent to help the material maintain a clear appearance. K-resin is easily colored with standard pigments, and lends itself well to molding the disclosed geometries. It also lends itself well to the strong snap-fits which are involved with the latching features which hold the modules together.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A modular display system comprising a plurality of display modules which can be assembled together, each said module comprising:

a vertical mounting surface lying in a mounting plane;

a pair of parallel sidewalls having opposed outside surfaces lying in side planes extending forward from said mounting plane at right angles to the mounting plane;

a bottom surface lying in a bottom plane extending forward from said mounting plane at right angles to said mounting plane and said sidewalls; and a top surface lying in a top plane extending forward from said mounting plane at right angles to the mounting plane and the side planes;

a pair of top rails lying above said top plane, each said top rail having an inner surface which faces said top plane to form a channel, said channels facing respective said side planes; and a pair of bottom rails extending inward from respective said sidewalls above said bottom plane, each said bottom rail having an inner surface which faces away from the bottom plane;

wherein said inner surfaces of the bottom rails converge toward the bottom plane at an acute angle, whereby said inner surfaces of said top rails of one module are received against said inner surfaces of said bottom rails of another module in a press fit when said top surface of said one module is received against said bottom surface of said another module and said modules are slid together until their mounting planes are substantially coplanar.

2. A modular display system as in claim 1 wherein each said module is designed to be molded as a single piece in a straight draw mold wherein an injection molding cavity is formed by only two mold halves.

3. A modular display as in claim 1 further comprising a floor extending between said sidewalls and spaced from said bottom surface, said floor being inclined at an acute angle to said bottom plane, said floor being formed with an open area extending from said mounting plane forward, said bottom rails being formed by the floor between the open area and the sidewalls.

4. A modular display system as in claim 3 wherein said floor is formed with a tongue extending into said open area, said tongue being formed with a detent, said top surface being formed with a shoulder, said detent of one module engaging the shoulder of another module to latch said modules together when said top surface of one module is slid against the bottom surface of another module until said mounting planes are substantially coplanar.

5. A modular display system as in claim 3 wherein said floor extends forward to a front end, said module further comprising:

a front wall extending upward from the front end of the floor; and at least one ledge extending between said sidewalls, each said ledge extending forward from said mounting plane to a support surface, whereby said at least one support surface, said floor, and said front wall can support a product at an angle to said bottom plane.

6. A modular display system as in claim 5 wherein said at least one ledge comprises a first ledge which is inclined at an acute angle to said floor, said mounting surface being open between said ledge and said floor and said acute angle converging toward said front wall.

7. A modular display system as in claim 6 wherein said at least one ledge further comprises a second ledge located above said first ledge and forming an acute angle with said first ledge which converges toward said mounting plane, said front wall ending below said first ledge.

8. A modular display system as in claim 1 wherein one of said sidewalls has a dovetail-shaped tenon standing proud of said outside surface and the other of said sidewalls has a dovetail-shaped mortise inset in said outside surface, wherein said dovetail tenon of one module is received in said dovetail mortise of another module in a press fit when the one sidewall of said one module is slid against the other sidewall of said another module until their mounting planes are substantially coplanar.

9. A modular display system as in claim 8 wherein said mortise and said tenon each diverge toward said mounting plane at an acute angle, whereby the one sidewall of said one module is slid forward against the other sidewall of said another module until the tenon is seated in the mortise and the mounting planes are substantially coplanar.

10. A modular display system as in claim 9 wherein said one sidewall has a recess extending into said one sidewall from said mounting plane and forming a shoulder below said outside surface and said other sidewall has a detent standing proud of said outside surface, wherein said detent of said another module engages said shoulder of said one module to latch said modules together when said modules are slid together until said mounting planes are substantially coplanar.

11. A modular display system as in claim 1 wherein one of said top surface and said bottom surface is provided with a detent and the other of said top surface and said bottom surface is provided with a shoulder, said detent of one module engaging the shoulder of another module to latch said modules together when said modules are slid together until said mounting planes are substantially coplanar.

12. A modular system as in claim 1 further comprising:

a pair of intermediate walls located centrally of said sidewalls and extending forward from said mounting plane; and a subfloor extending between each intermediate wall and the adjacent sidewall, said subfloors being coplanar and spaced from said bottom plane to form a pair of recesses, said inner rails extending into said recesses.

13. A modular display system as in claim 12 wherein said bottom surface comprises a pair of edge portions formed by said sidewalls and a central portion extending between said intermediate walls, said mounting surface comprising a pair of edge portions formed by said sidewalls and a central portion extending between said intermediate walls.

14. A modular display system as in claim 12 further comprising a pair of platforms standing proud of said top surface, said top rails being formed by respective said platforms, wherein said platforms of one module are received in said recesses of another module when said top surface of said one module is received against said bottom surface of said another module and said modules are slid together until their mounting planes are substantially coplanar.

15. A modular display system as in claim 12 wherein said intermediate walls extend forward to support edges which lie in a common rear support plane, said system further comprising a pair of floors extending forward from said subfloors in a common bottom support plane which is inclined at an acute angle to said bottom plane and is substantially normal to said rear support plane, whereby products can be supported on said floors and against said support edges.

16. A modular display system as in claim 15 further comprising a pair of transverse walls extending between each intermediate wall and the adjacent sidewall, said transverse walls extending substantially normally of said subfloors and connecting respective said subfloors to respective said floors.

17. A modular display as in claim 15 further comprising:

a pusher plate which is substantially parallel to said rear support plane and is spring-loaded away from said rear support plane; and a forward stop upstanding from each said floor, said forward stop limiting forward travel of product which is pushed forward by said pusher plate.

18. A modular display as in claim 17 further comprising a track plate positioned between said floors, said track plate guiding said pusher plate on a linear path as it moves forward.

* * * * *